US009435184B2

(12) United States Patent
Davis et al.

(10) Patent No.: US 9,435,184 B2
(45) **Date of Patent: *Sep. 6, 2016**

(54) SACRIFICIAL LINER LINKAGES FOR AUTO-SHORTENING AN INJECTION PIPE FOR UNDERGROUND COAL GASIFICATION

(75) Inventors: Burl Edward Davis, New Kensington, PA (US); Clifford William Mallett, St. Lucia (AU); Marion Russell Mark, Mermaid Waters (AU)

(73) Assignee: CARBON ENERGY LIMITED, Milton, Queensland (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/536,082

(22) Filed: Jun. 28, 2012

(65) Prior Publication Data

US 2014/0000873 A1 Jan. 2, 2014

(51) Int. Cl.
*E21B 17/00* (2006.01)
*E21B 43/243* (2006.01)
*E21B 17/06* (2006.01)

(52) U.S. Cl.
CPC ..... *E21B 43/243* (2013.01); *E21B 17/06* (2013.01)

(58) Field of Classification Search
USPC ..... 166/256, 297, 376, 55, 50
See application file for complete search history.

(56) References Cited

U.S. PATENT DOCUMENTS 3,051,244 A * 8/1962 Litchfield ..... 166/317
3,106,959 A * 10/1963 Huitt et al. ..... 166/308.1
3,563,606 A 2/1971 Sears
3,734,180 A 5/1973 Rhoades
3,775,073 A 11/1973 Rhoades
3,987,852 A 10/1976 Terry
4,122,897 A 10/1978 Capp et al.
4,296,809 A 10/1981 Tsai et al.
4,422,505 A 12/1983 Collins
4,512,403 A 4/1985 Santangelo
4,551,155 A 11/1985 Wood et al.
4,705,109 A * 11/1987 Ledent et al. ..... 166/251.1
4,754,811 A 7/1988 Ledent et al.
5,040,601 A * 8/1991 Karlsson et al. ..... 166/278
5,826,655 A 10/1998 Snow et al.
6,755,249 B2 6/2004 Robison et al.
7,231,977 B2 6/2007 Keller
7,784,533 B1 * 8/2010 Hill ..... 166/59
7,861,743 B1 1/2011 Wren (Continued)

FOREIGN PATENT DOCUMENTS

AU 2010236110 12/2011
BE 1012151 6/2000

(Continued)

OTHER PUBLICATIONS

PCT International Search Report of PCT/US13/47168; dated Nov. 15 2013 (2 pgs.).

(Continued)

*Primary Examiner* — Taras P Bemko
(74) *Attorney, Agent, or Firm* — DLA Piper LLP (US)

(57) ABSTRACT

A sacrificial liner linkage that can be used to automatically shorten a liner for an underground coal gasification process is provided. The sacrificial liner linkage may be one or more sacrificial liner linkage portions that are spaced between one or more liner portions in which the sacrificial liner linkage portions disintegrate before the one or more liner portions to automatically shorten the liner.

9 Claims, 4 Drawing Sheets

(56) References Cited

U.S. PATENT DOCUMENTS

| | | | | |
|---|---|---|---|---|
| 2006/0151913 | A1 | 7/2006 | Graham | |
| 2007/0295503 | A1 | 12/2007 | Maguire | |
| 2008/0000637 | A1 | 1/2008 | McDaniel et al. | |
| 2008/0122286 | A1 | 5/2008 | Brock et al. | |
| 2008/0236817 | A1 | 10/2008 | Tillman | |
| 2008/0251074 | A1* | 10/2008 | Sand | 128/204.18 |
| 2009/0008088 | A1 | 1/2009 | Schultz et al. | |
| 2010/0038076 | A1 | 2/2010 | Spray et al. | |
| 2010/0181069 | A1 | 7/2010 | Schneider | |
| 2010/0251728 | A1 | 10/2010 | Uselton | |
| 2010/0299997 | A1 | 12/2010 | Hoteit et al. | |
| 2011/0114311 | A1 | 5/2011 | Best | |
| 2011/0139432 | A1 | 6/2011 | Freeman | |
| 2012/0103611 | A1 | 5/2012 | Brandl et al. | |

FOREIGN PATENT DOCUMENTS

| | | |
|---|---|---|
| CA | 2 313 837 | 9/2004 |
| CA | 2 632 170 | 11/2008 |
| CN | 1136635 | 11/1996 |
| CN | 1169501 | 1/1998 |
| CN | 1186897 | 7/1998 |
| CN | 1320763 | 11/2001 |
| CN | 1392328 | 1/2003 |
| CN | 1419036 | 5/2003 |
| CN | 1429967 | 7/2003 |
| CN | 2600588 | 1/2004 |
| CN | 1500967 | 6/2004 |
| CN | 2658751 | 11/2004 |
| CN | 1590704 | 3/2005 |
| CN | 1651714 | 8/2005 |
| CN | 1667241 | 9/2005 |
| CN | 1673487 | 9/2005 |
| CN | 1673489 | 9/2005 |
| CN | 2785287 | 5/2006 |
| CN | 2802082 | 8/2006 |
| CN | 1854459 | 11/2006 |
| CN | 2844436 | 12/2006 |
| CN | 1908367 | 2/2007 |
| CN | 1982647 | 6/2007 |
| CN | 101105122 | 1/2008 |
| CN | 101113670 | 1/2008 |
| CN | 101113671 | 1/2008 |
| CN | 101315026 | 3/2008 |
| CN | 101251005 | 8/2008 |
| CN | 1673488 | 9/2008 |
| CN | 201126190 | 10/2008 |
| CN | 201141701 | 10/2008 |
| CN | 201184182 | 1/2009 |
| CN | 201196071 | 2/2009 |
| CN | 101381149 | 3/2009 |
| CN | 101382062 | 3/2009 |
| CN | 101382063 | 3/2009 |
| CN | 101382064 | 3/2009 |
| CN | 101382066 | 3/2009 |
| CN | 101424181 | 5/2009 |
| CN | 101463721 | 6/2009 |
| CN | 101509368 | 8/2009 |
| CN | 101581210 | 11/2009 |
| CN | 101581212 | 11/2009 |
| CN | 101586915 | 11/2009 |
| CN | 201381844 | 1/2010 |
| CN | 201381852 | 1/2010 |
| CN | 101649735 | 2/2010 |
| CN | 101660405 | 3/2010 |
| CN | 101760249 | 6/2010 |
| CN | 101775978 | 7/2010 |
| CN | 101832137 | 9/2010 |
| CN | 101864940 | 10/2010 |
| CN | 101864941 | 10/2010 |
| CN | 101864942 | 10/2010 |
| CN | 101922287 | 12/2010 |
| CN | 201748474 | 2/2011 |
| CN | 101988383 | 3/2011 |
| CN | 101988384 | 3/2011 |
| CN | 102031126 | 4/2011 |
| CN | 201802362 | 4/2011 |
| CN | 201810401 | 4/2011 |
| CN | 102080529 | 6/2011 |
| CN | 102094615 | 6/2011 |
| CN | 102220858 | 10/2011 |
| CN | 202039831 | 11/2011 |
| JP | 2004-003326 | 1/2004 |
| JP | 2004-3326 | 1/2004 |
| RU | 2 090 750 | 9/1997 |
| RU | 2 099 517 | 12/1997 |
| RU | 2 100 588 | 12/1997 |
| RU | 2 209 305 | 11/2000 |
| RU | 2 165 019 | 4/2001 |
| RU | 2 177 544 | 12/2001 |
| RU | 2 186 209 | 3/2002 |
| RU | 2 298 093 | 4/2007 |
| RU | 2300630 | 6/2007 |
| RU | 2311531 | 11/2007 |
| RU | 2316649 | 2/2008 |
| RU | 2318117 | 2/2008 |
| RU | 2 349 759 | 9/2008 |
| RU | 2 347 070 | 2/2009 |
| RU | 2 347 071 | 2/2009 |
| RU | 2 352 820 | 5/2009 |
| RU | 2 358 102 | 6/2009 |
| RU | 2 358 915 | 6/2009 |
| RU | 2 359 116 | 6/2009 |
| RU | 2 360 106 | 6/2009 |
| RU | 2 398 105 | 6/2009 |
| RU | 2 307 244 | 12/2009 |
| RU | 2 378 506 | 1/2010 |
| RU | 2 381 356 | 2/2010 |
| RU | 2 381 357 | 2/2010 |
| RU | 2 382 879 | 2/2010 |
| RU | 2 383 728 | 3/2010 |
| RU | 2 385 411 | 3/2010 |
| RU | 2 385 412 | 3/2010 |
| RU | 2 390 634 | 5/2010 |
| RU | 2008 146 353 | 5/2010 |
| RU | 2 319 838 | 6/2010 |
| RU | 2 391 508 | 6/2010 |
| RU | 2 392 427 | 6/2010 |
| RU | 2 392 431 | 6/2010 |
| RU | 2 392 432 | 6/2010 |
| RU | 2396305 | 8/2010 |
| RU | 2009144838 | 6/2011 |
| RU | 2009145665 | 6/2011 |
| RU | 2010115500 | 11/2011 |
| RU | 2439313 | 1/2012 |
| RU | 2443857 | 2/2012 |
| UA | 77 132 | 10/2006 |
| UA | 79 893 | 7/2007 |
| UA | 31 102 | 3/2008 |
| WO | WO 96/28637 | 9/1996 |
| WO | WO 99/63200 | 12/1999 |
| WO | WO 2006/104425 | 10/2006 |
| WO | WO 2008/033268 | 3/2008 |
| WO | WO 2009/157811 | 12/2009 |

OTHER PUBLICATIONS

PCT Written Opinion of PCT/US13/47168; dated Nov. 15 2013 (4 pgs.).

* cited by examiner

SACRIFICIAL LINER LINKAGES FOR AUTO-SHORTENING AN INJECTION PIPE FOR UNDERGROUND COAL GASIFICATION

FIELD

The disclosure relates generally to underground coal gasification ("UCG") and in particular to sacrificial liner linkages for use in underground coal gasification.

BACKGROUND

It is well known that underground coal may be gasified and the gasification of the coal process (the UCG process) produces syngas. This process involves the operation of a gasification reactor cavity (the reactor) between parallel horizontal boreholes within a coal seam that is fed with an oxidant gas, examples are air, oxygen, steam or combinations of these gases, through one borehole (the injection well). After ignition of the seam, gasification reactions between the coal and injected oxidant gases form syngas (a mixture of CO, $CO_2$, $H_2$, $CH_4$, and other gasses) and the syngas is removed via the second borehole (the product well).

In the coal gasification process, there are a number of reactions that occur which generate the syngas. Those reactions include:

$C+H_2O=H_2+CO$ (Hetergeneous water-gas shift reaction)

$CO+H_2O=H_2+CO_2$ (Shift conversion)

$CO+3H_2=CH4+H_2O$ (Methanation)

$C+2H_2=CH4$ (Hydrogenating gasification)

$C+\frac{1}{2}O_2=CO$ (Partial oxidation)

$C+O_2=CO_2$ (Oxidation)

$C+CO_2=2\ CO$ (Boudouard reaction)

In the typical UCG process, as coal is removed by the gasification process, the cavity grows in size and the coal face gradually migrates, as coal is removed by hot gases flowing across the face. When injection gases are fed into the reactor via a liner within the injection well, the emission point of the gas is fixed at the end of the injection well liner. With growth of the reactor, the hot reaction zone of gasification moves away from the injection point of the oxidant gases, which reduces the efficiency of the gasification process resulting in a decline in product quality. There is a known shortening of the injection point process that is known as Continuous Retracting Injection Point (CRIP).

The currently used method to maintain gas quality is to move the injection point of the oxidant gases to match the movement of the coal gasification face, so the injected gases are always accessing fresh coal and product quality is maintained. The movement of the end of the injection well liner is typically achieved by either shortening the liner by cutting off a section of the liner to relocate the delivery point for the oxidant gases, or withdrawing the liner up the injection well which moves the point of injection. The cutting of the injection well liner or withdrawing it from the injection well both achieve re-positioning of the injection point, but require significant logistic operations and specialized equipment operated from the surface, to achieve the objectives. It is desirable to be able to move the injection point of the oxidant gases along with the movement of the gasification face, without the use of devices inserted into the injection well and operated from the surface, such as cutters or liner withdrawal equipment.

Thus, it is desirable to provide sacrificial liner linkages for automatically shortening a liner for underground coal gasification and it is to this end that the disclosure is directed. This sacrificial liner linkage process for shortening can apply to all UCG activities which require a repositioning of the injection point in a horizontal injection well within the coal seam.

DETAILED DESCRIPTION OF ONE OR MORE EMBODIMENTS

The disclosure is particularly applicable to an underground coal gasification process (UCG) that uses an injection well liner with sacrificial liner linkages and it is in this context that the disclosure will be described.

Figure 1:
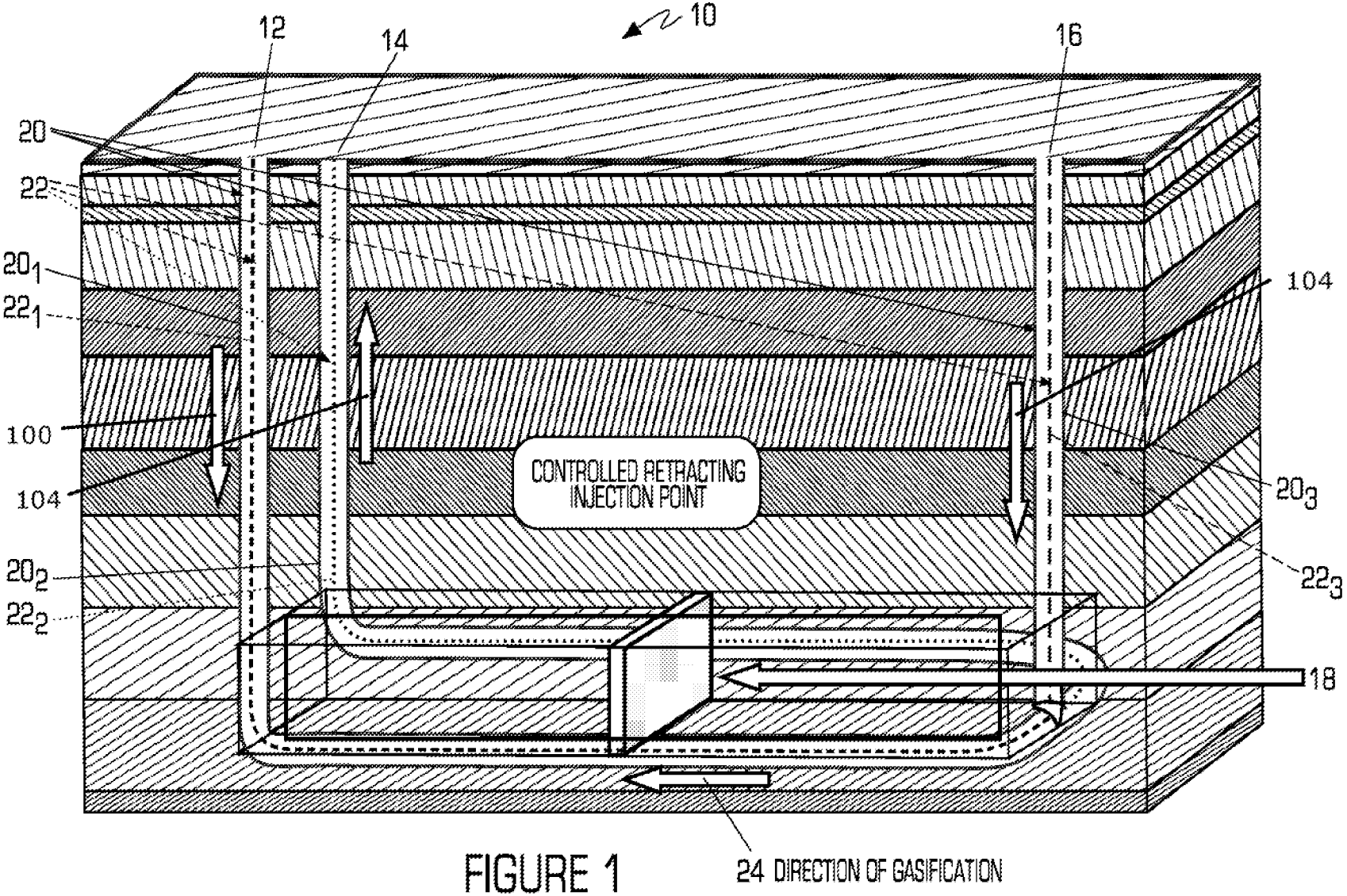
FIG. 1 illustrates an example of an underground coal gasification apparatus that may utilize sacrificial liner linkages.

FIG. 1 illustrates an example of an underground coal gasification apparatus 10 that may utilize sacrificial liner linkages. The apparatus 10 may include an injection well 12, a production well 14 and an initiation well 16. During the UCG process, the injection well 12 is used to inject an oxidizing gas (such as air, oxygen, steam or combinations of these gases as shown by the arrow 100) into a reactor area 18 (also known as a gasification cavity) that is a cavity in the coal created initially by drilling and subsequently expanded by gasification of the coal. The cavity forms between the point of injection and the roof of the coal seam and laterally grows to the limit of the gasification process. During the UCG process, the production well 14 is used to extract the syngas formed during the UCG process as shown by arrow 102 and the initiation well 16 is used to initiate the gasification process in a coal seam as shown by the arrow 104 in FIG. 1. Each of the wells has a casing 20 ($\mathbf{20}_1$ being a casing of the injection well, $\mathbf{20}_2$ being a casing of the production well and $\mathbf{20}_3$ being a casing of the initiation well) and a liner 22 ($\mathbf{22}_k$ being a liner of the injection well, $\mathbf{22}_2$ being a liner of the production well and $\mathbf{22}_3$ being a liner of the initiation well) that is within each casing. A typical diameter of casing is 250 mm and for a liner is 100 to 130 mm. In the disclosure below, we are focused on the injection well liner $\mathbf{22}_1$. During the UCG process, the coal is gasified and the gasification cavity moves away from the injection point at the end of the injection well and the injection well liner. In the example in FIG. 1, a direction 24 of the gasification process is from right to left as shown by the arrow. A key aspect of the UCG process is to move the injection point of the oxidant gases to match the movement of the coal gasification face without having to cut the injection well liner or retract the injection well liner as will now be described in more detail.

Figure 2:
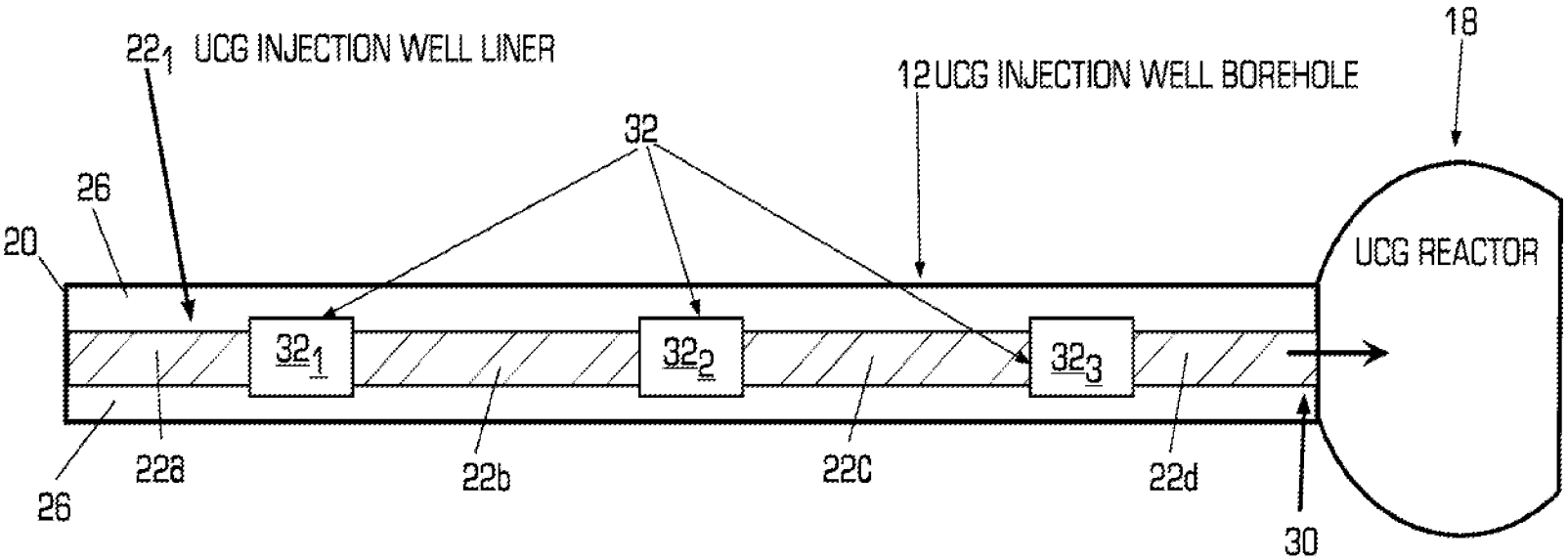
FIG. 2 illustrates a close up view of a reactor and sacrificial liner linkages that are used to automatically shorten the liner.

FIG. 2 illustrates a close up view of a reactor and sacrificial liner linkages that are used to automatically shorten the liner. The injection well 12 has a point 30 at which the oxidizing gas is injected into the gasification cavity 18 at the end of the injection liner $\mathbf{22}_1$. As shown in FIG. 2, the injection well has the liner $\mathbf{22}_1$ and an annulus 26 between the edge of the borehole and the liner. The injection liner $\mathbf{22}_1$ may have one or more liner portions (such as 22*a*, 22*b*,22*c*,22*d* in FIG. 2) and one or more sacrificial liner linkages 32 (such as liner portions $\mathbf{32}_1$, $\mathbf{32}_2$ and $\mathbf{33}_3$ in the example shown in FIG. 2) in between the liner portions. The liner 22 typically has sacrificial liner linkages at periodic intervals of 6 to 8 meters. The injection liner $\mathbf{22}_1$ may be made of steel (or similar material) to withstand the rigors of the UCG process. The steel may not melt/disintegrate at a temperature below 600° C. Each sacrificial liner linkage 32 (that may also be known as a linkage) may be made of a material that melts/burns/disintegrates at a temperature below that at which the steel liner melts/disintegrates. For example, each sacrificial liner linkage 32 may be made of fiberglass or a resin material. A typical resin is high-temperature epoxy tooling resin. The sacrificial liner linkage and liner portions are joined together by threaded joints. In one embodiment shown in FIG. 2, the liner and the liner portions have a circular shape (like a pipe) while each sacrificial liner linkage portion 32 has a square or rectangular shape. However, each sacrificial liner linkage portion 32 may also have other shapes including a circular shape similar to the other liner portions. In the configuration shown in FIG. 2, the temperature along the length of the injection well liner is less than 200 degrees Celsius and both the liner portions and sacrificial liner linkages allow the oxidizing gases to flow to the gasification cavity internal to the liner.

Figure 3:
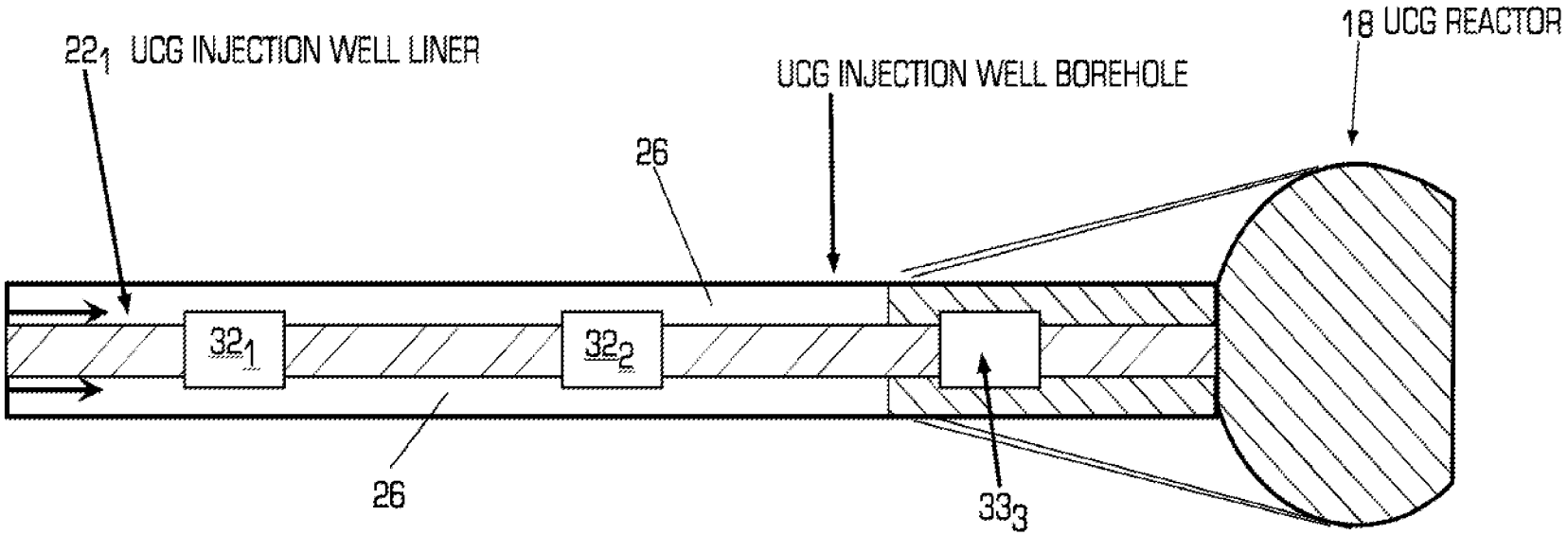
FIG. 3 illustrates details of the underground coal gasification process in which sacrificial liner linkages of the liner are impinged by the heat of the UCG process.
Figure 4:
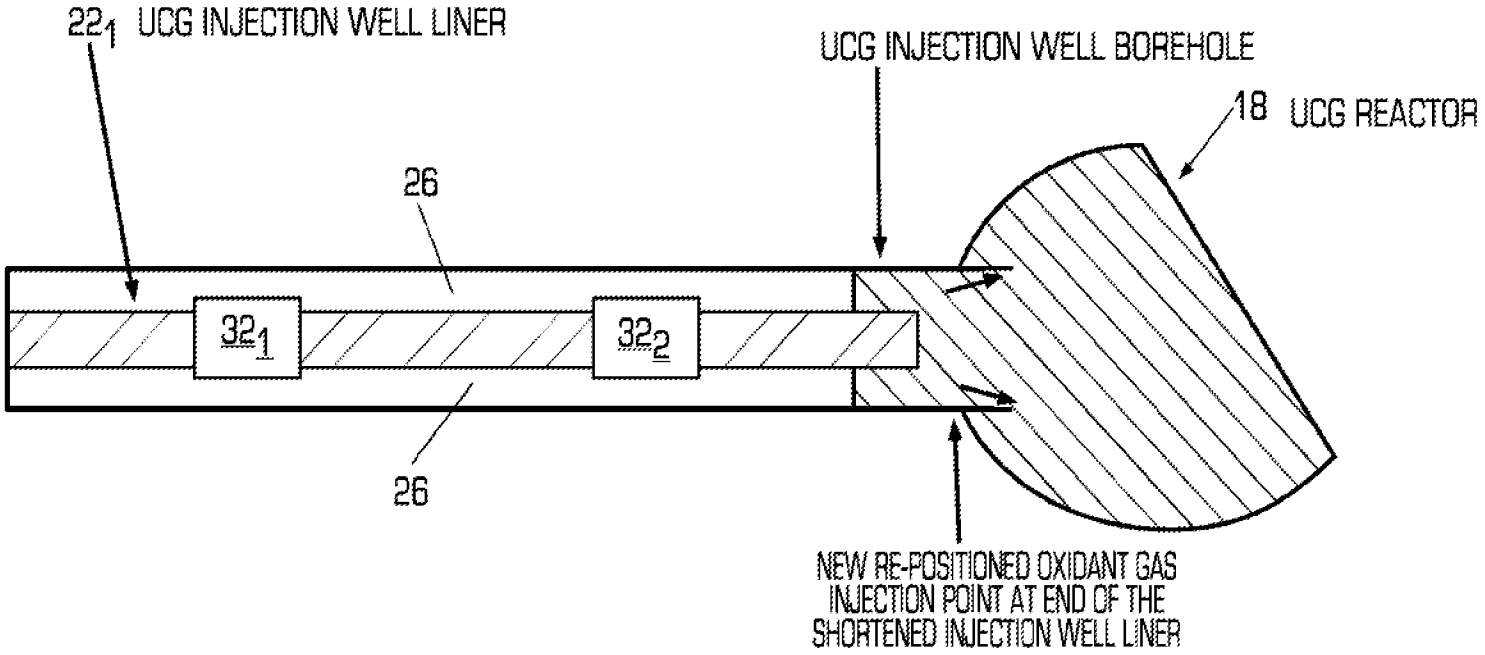
FIG. 4 illustrates details of the underground coal gasification process when the sacrificial liner linkages are eliminated thus automatically shortening the liner.

FIG. 3 illustrates details of the underground coal gasification process in which sacrificial liner linkages of the liner are impinged by the hot zone of the UCG process. As shown in FIG. 3, a particular sacrificial liner linkage portion that has been engulfed by the hot zone of the gasification cavity deforms, burns or melts (possibly into the gasification cavity) which results in the length of the injection well liner being automatically shortened (as shown in FIG. 4) at the appropriate time so that the injection point of the oxidant gases (at the end of the liner) is automatically moved with the coal face. For example, in one embodiment, the sacrificial liner linkage portion may melt/disintegrate at a temperature of about 350 degrees Celsius.

While the foregoing has been with reference to a particular embodiment of the invention, it will be appreciated by those skilled in the art that changes in this embodiment may be made without departing from the principles and spirit of the disclosure, the scope of which is defined by the appended claims.

The invention claimed is:

1. An injection well liner for an underground coal gasification process, the injection well liner comprising:

a proximal end and a distal end of the injection well liner through which an oxidizing gas is injected for an underground coal gasification process, the oxidizing gas being injected at the proximal end and output at a distal end of the injection well liner, the injection well liner having one or more liner portions and one or more sacrificial liner portions in between the one or more liner portions; and wherein each of the one or more sacrificial liner portions individually and entirely disintegrate due to a temperature during the underground coal gasification process so that each sacrificial liner and the liner portion connected to a distal end of each sacrificial liner fall off and the injection well liner is automatically shortened during the underground coal gasification process.

2. The injection well liner of claim 1, wherein each of the one or more sacrificial liner portions disintegrate at a lower temperature than the one or more liner portions.

3. The injection well liner of claim 2, wherein each of the one or more sacrificial liner portions disintegrate at a temperature of 350 degrees Celsius.

4. The injection well liner of claim 1, wherein each of the one or more sacrificial liner portions is made of one of a fiberglass and a resin.

5. The injection well liner of claim 4, wherein the resin is a high temperature epoxy tooling resin with comparable mechanical properties to a steel liner portion.

6. The injection well liner of claim 1, wherein each of the one or more sacrificial liner portions has a predetermined distance between another sacrificial liner portion.

7. The injection well liner of claim 1, wherein each of the one or more sacrificial liner portions melts.

8. The injection well liner of claim 1, wherein each liner portion is made of steel.

9. The injection well liner of claim 1, wherein each liner portion and each sacrificial liner portion is connected together by a threaded joint.

* * * * *